US007478703B2

(12) United States Patent
Nakamura

(10) Patent No.: US 7,478,703 B2
(45) Date of Patent: Jan. 20, 2009

(54) SPEAKER CABINET AND SPEAKER DEVICE

(75) Inventor: Takeshi Nakamura, Uji (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 376 days.

(21) Appl. No.: 10/794,061

(22) Filed: Mar. 8, 2004

(65) Prior Publication Data

US 2004/0222038 A1 Nov. 11, 2004

(30) Foreign Application Priority Data

May 9, 2003 (JP) ..... 2003-132283

(51) Int. Cl.
*A47B 81/06* (2006.01)

(52) U.S. Cl. ..... 181/199; 181/148

(58) Field of Classification Search ..... 181/148, 181/199

See application file for complete search history.

(56) References Cited

U.S. PATENT DOCUMENTS

| | | | | |
|---|---|---|---|---|
| 2,878,887 | A * | 3/1959 | Potter | 181/151 |
| 3,207,257 | A * | 9/1965 | Wilson | 181/147 |
| 3,547,220 | A * | 12/1970 | Watson | 181/171 |
| 3,731,760 | A * | 5/1973 | Hammes | 181/199 |
| 4,164,988 | A * | 8/1979 | Virva | 181/156 |
| 4,257,325 | A * | 3/1981 | Bertagni | 181/172 |
| 4,280,585 | A * | 7/1981 | Nakanishi | 181/147 |
| 4,408,678 | A * | 10/1983 | White, Jr. | 181/199 |
| 4,616,731 | A * | 10/1986 | Robinson | 181/148 |
| 5,327,985 | A * | 7/1994 | Porzilli | 181/177 |
| 5,550,926 | A * | 8/1996 | Tsao | 381/386 |
| 6,283,437 | B1 | 9/2001 | Kang | |
| 6,367,579 | B1 * | 4/2002 | Wiener | 181/199 |
| 6,411,721 | B1 * | 6/2002 | Spindler | 381/349 |
| 6,484,843 | B2 * | 11/2002 | Yoshii et al. | 181/153 |
| 6,719,092 | B1 * | 4/2004 | Barbetta | 181/199 |
| 6,796,401 | B2 * | 9/2004 | Yoshii et al. | 181/166 |
| 7,181,039 | B2 * | 2/2007 | Stiles et al. | 381/397 |
| 7,212,644 | B2 * | 5/2007 | Gavriliu et al. | 381/353 |
| 2001/0042657 | A1 * | 11/2001 | Yoshii et al. | 181/199 |
| 2002/0097887 | A1 * | 7/2002 | Gavriliu et al. | 381/338 |
| 2003/0141142 | A1 * | 7/2003 | Christiansen | 181/199 |
| 2003/0173145 | A1 * | 9/2003 | Groth et al. | 181/153 |

(Continued)

FOREIGN PATENT DOCUMENTS

| | | |
|---|---|---|
| DE | 90 03 498 U1 | 8/1990 |

(Continued)

*Primary Examiner*—Walter Benson
*Assistant Examiner*—Forrest M Phillips
(74) *Attorney, Agent, or Firm*—Keating & Bennett, LLP

(57) ABSTRACT

A speaker cabinet includes a cabinet having a side board to which a speaker driver can be fixed, a substantially cylindrical tube which is inserted into the cabinet such that a vertical line passing through the center of gravity of a horizontal plane of the cabinet coincides with the axis of the substantially cylindrical tube and which is in contact with the base board and the top board of the cabinet, and a support rod which is inserted into the substantially cylindrical tube through a through-hole formed in the base board of the cabinet and which supports the top board of the cabinet at the upper end portion of the support rod such that the cabinet undulates so as to move like a see-saw.

16 Claims, 3 Drawing Sheets

U.S. PATENT DOCUMENTS

| | | | | |
|---|---|---|---|---|
| 2004/0222038 | A1* | 11/2004 | Nakamura | 181/199 |
| 2004/0251077 | A1* | 12/2004 | Wright et al. | 181/151 |
| 2005/0169494 | A1* | 8/2005 | Stiles et al. | 381/337 |
| 2007/0104347 | A1* | 5/2007 | Stiles et al. | 381/397 |

FOREIGN PATENT DOCUMENTS

| | | | |
|---|---|---|---|
| JP | 03088598 | * | 4/1991 |
| JP | 10-304484 | | 11/1998 |
| JP | 11-146471 | | 5/1999 |
| JP | 11-289588 | | 10/1999 |
| JP | 11-355876 | | 12/1999 |

* cited by examiner

SPEAKER CABINET AND SPEAKER DEVICE

BACKGROUND OF THE INVENTION

1. Field of the Invention

The present invention relates to a speaker cabinet and a speaker device, and more particularly to the structure of a speaker cabinet in which a speaker driver is fixed and a speaker device including the speaker cabinet.

2. Description of the Related Art

Speaker devices are generally constructed as shown in FIG. 3. This speaker device 51 includes a speaker cabinet 52. In the speaker cabinet 52, the frame of a speaker driver 53 generating sound by being vibrated back and forth is fixed to a side board 54*a*, and a box-type hollow cabinet 54, which is arranged such that a base board 54*b* is put into contact with a floor surface F, is contained.

In the speaker device 51 containing the speaker cabinet 52, undesirable vibration transmitted from the speaker driver 53 is largely absorbed by the cabinet 54. The rest of the vibration that is not absorbed is transmitted to the floor surface F from the base board 54*b* of the cabinet 54 and is diffused.

In an audio system using the speaker device 51 as a related speaker device, an auxiliary speaker (tweeter) for reproducing a high-frequency range and having a small amplitude, etc., is added. At this time, since the auxiliary speaker is required to be made smaller and to satisfy certain conditions for directivity, etc., as shown in FIG. 3, an auxiliary speaker 71 is generally placed on and fixed to the speaker cabinet 52 of the speaker device 51.

However, when constructed in this way, the following problems occur. That is, in the speaker device 51, undesirable vibration is mostly absorbed by the cabinet 54 of the speaker cabinet 52, and only the vibration left unabsorbed is diffused from the base board 54*b* of the cabinet 54 to the floor surface F.

On the contrary, when a large sound volume is generated in the speaker driver 53, since the undesirable vibration also increases, it becomes difficult for the cabinet 54 of the speaker cabinet 52 to fully absorb the vibration. Then, the amount of vibration which can be diffused from the base board 54*b* of the cabinet 54 to the floor surface F is also limited and, as a result, the speaker cabinet 52 undulates back and forth at the center in the vicinity of the base board 54*b* of the cabinet 54.

Under such conditions, the top surface of the speaker cabinet 52, that is, the top board 54*c* of the cabinet 54, greatly undulates back and forth and, since the amplitude at this portion becomes the greatest, the auxiliary speaker 71 having a small amplitude placed on the top board 54*c* of the cabinet 54 greatly undulates. As a result, the position of the sound source of the auxiliary speaker 71 becomes unstable and the main objective of adding the auxiliary speaker 71 cannot be obtained.

SUMMARY OF THE INVENTION

In order to overcome the problems described above, preferred embodiments of the present invention provide a speaker cabinet which is constructed such that the position of the sound source of an auxiliary speaker is stabilized, and also provide a speaker device including such a novel speaker cabinet.

A speaker cabinet according to a first preferred embodiment of the present invention includes a cabinet having a side board to which a speaker driver can be fixed, a substantially cylindrical tube which is inserted into the cabinet such that a vertical line passing through the center of gravity of a horizontal plane of the cabinet coincides with the axis of the substantially cylindrical tube and which is in contact with the base board and the top board of the cabinet, and a support rod which is inserted into the substantially cylindrical tube through a through-hole formed in the base board of the cabinet and which supports the top board of the cabinet at the upper end portion of the support rod such that the cabinet undulates so as to move like a see-saw.

It is desirable that the upper end portion of the support rod has a sharp point and a bearing portion, which is in contact with the upper end portion of the support rod, provided in the top board of the cabinet. Furthermore, it is desirable that a buffer material be placed between the inner surface of the through-hole formed in the base board of the cabinet and the outer surface of the support rod.

A speaker device according to a second preferred embodiment of the present invention includes a speaker cabinet according to the first preferred embodiment of the present invention, and a speaker driver is fixed to the side board of the cabinet.

Other features, elements, characteristics and advantages of the present invention will become more apparent from the following detailed description thereof with reference to the attached drawings.

DETAILED DESCRIPTION OF PREFERRED EMBODIMENTS

Figure 1:
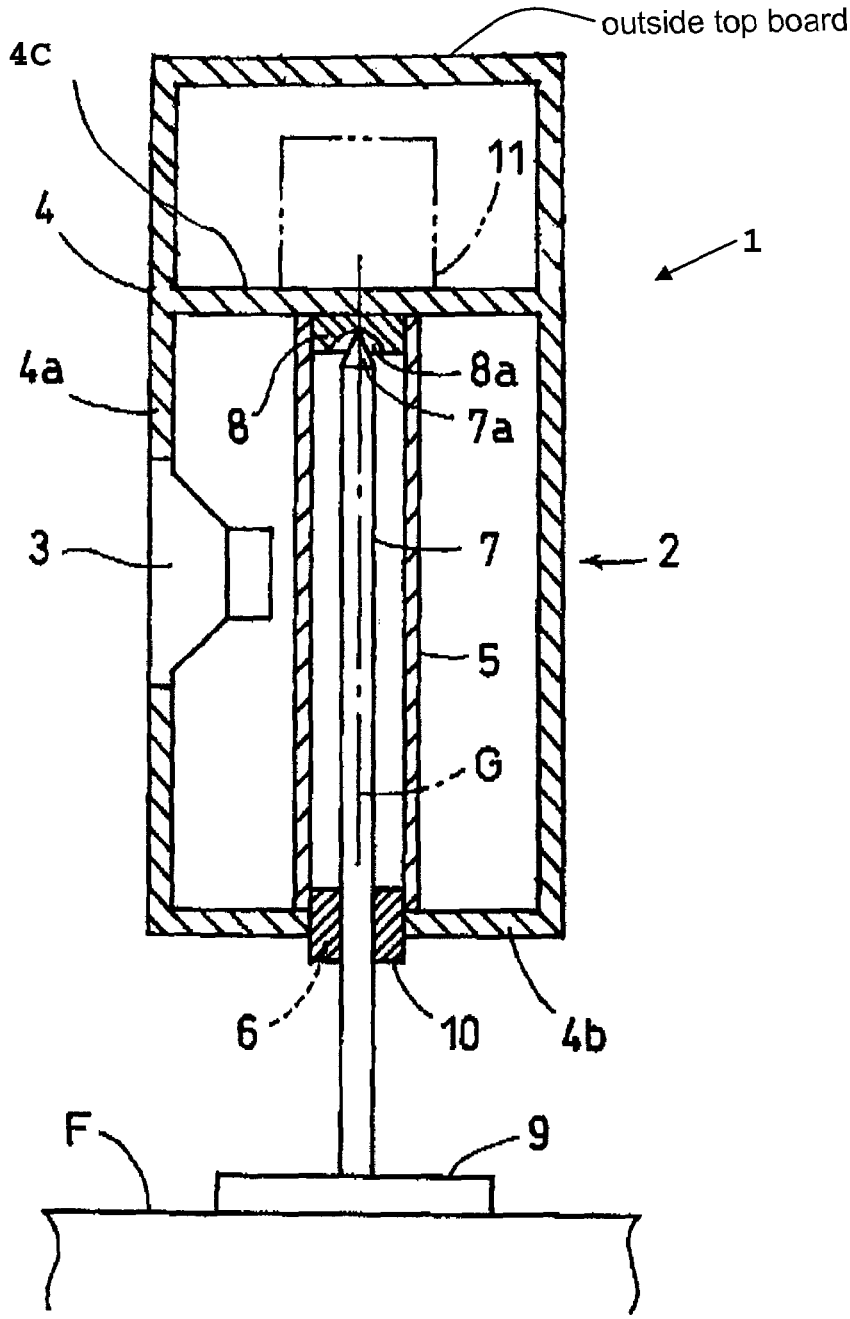
FIG. 1 is a transverse sectional view schematically showing the structure of a speaker device according to a first preferred embodiment of the present invention.
Figure 2:
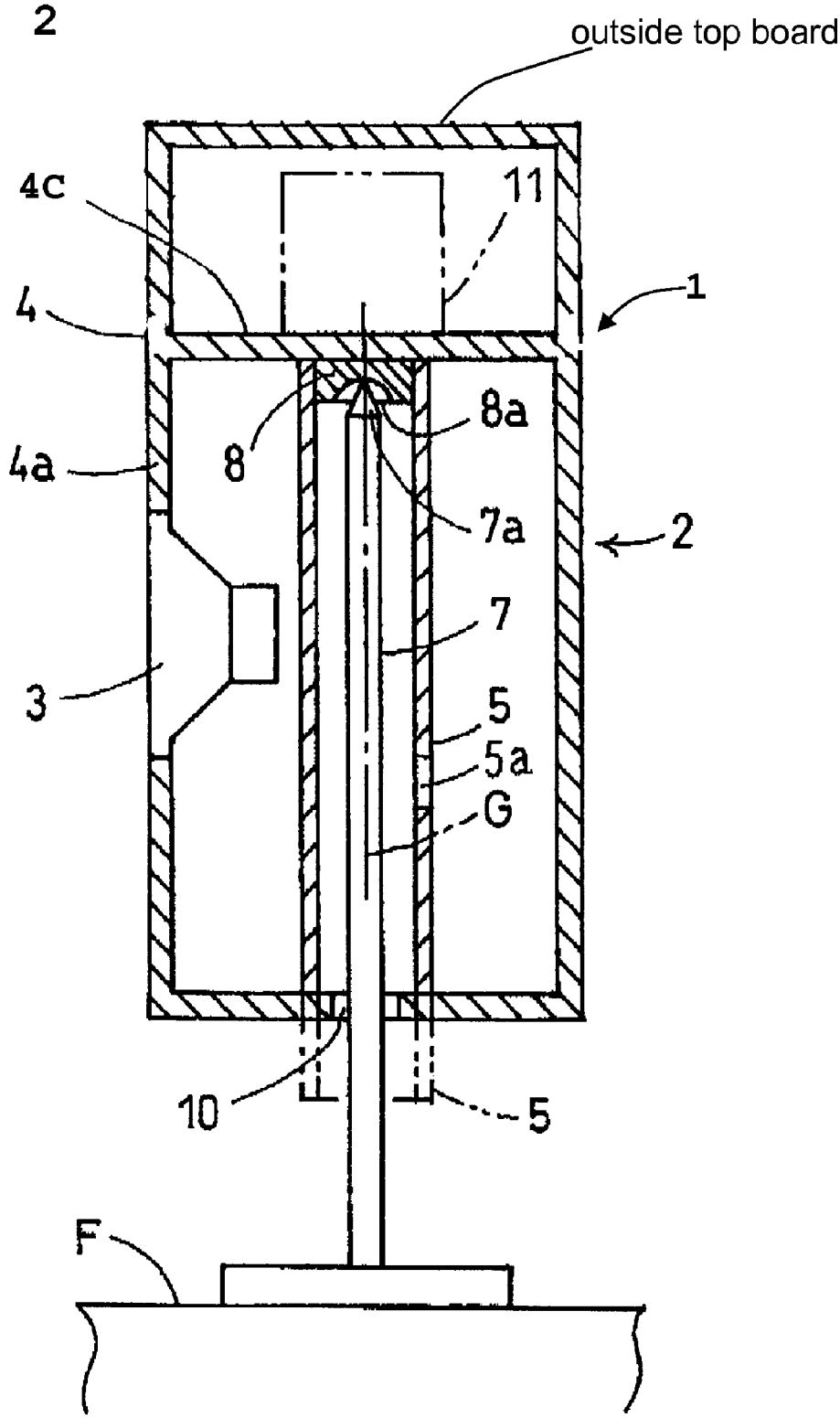
FIG. 2 is a transverse sectional view schematically showing the structure of a modified example of the speaker device according to a preferred embodiment of the present invention.
Figure 3:
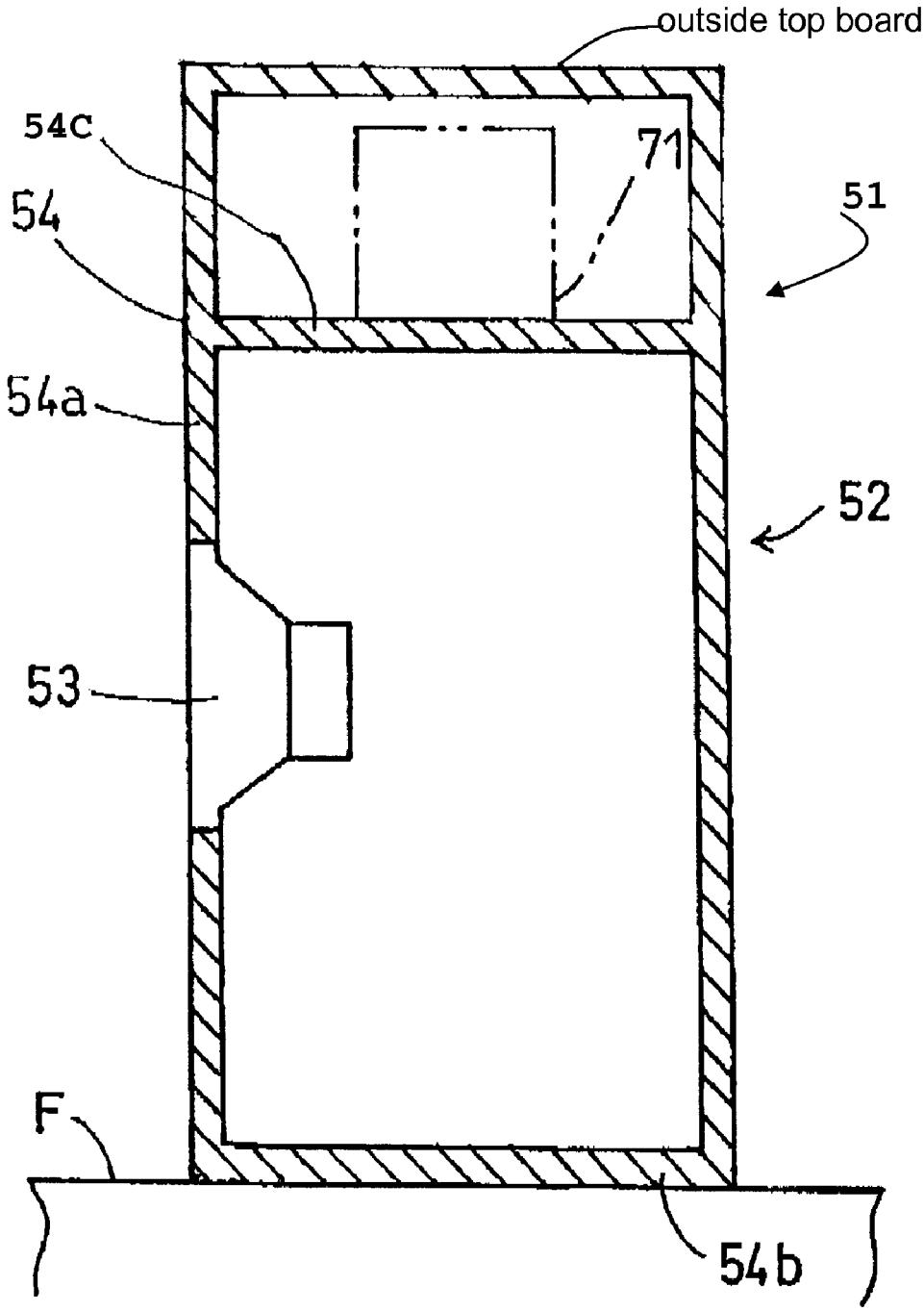
Fig. 3 Prior Art
FIG. 3 is a transverse sectional view schematically showing the structure of a related speaker device.

FIG. 1 is a transverse sectional view schematically showing the structure of a speaker device according to a preferred embodiment of the present invention, and FIG. 2 is a transverse sectional view schematically showing the structure of a modified example of the speaker device according to a preferred embodiment of the present invention. Moreover, reference numeral 1 in FIGS. 1 and 2 represents a speaker device of the present preferred embodiment, and, in FIGS. 1 and 2, the common parts and portions are given the same reference numerals.

A speaker device 1 according to a preferred embodiment of the present invention includes a speaker cabinet 2 and the speaker device is preferably constructed as shown in FIG. 1. The speaker cabinet 2 includes a box-type hollow cabinet 4 in which the frame of a speaker driver 3 generating sound by being vibrated back and forth is fixed to a side board 4*a*, a hollow pipe 5 such as a substantially cylindrical tube which is inserted into the cabinet 4 such that a vertical line G passing through the center of gravity of a horizontal plane of the cabinet 4 coincides with the axis of the hollow pipe 5 and which is in contact with the base board 4*b* and the top board 4*c* of the cabinet 4, and a support rod 7 which is inserted into the hollow pipe 5 through a through-hole 6 formed in the base board 4*b* of the cabinet 4 and which supports the top board 4*c* of the cabinet 4 at the upper end of the support rod 7 such that the cabinet 4 undulates so as to move like a see-saw.

At this time, the bottom surface and the top surface of the hollow pipe 5 are fixed so as to adhere closely to the base board 4*a* and the top board 4*c* of the cabinet 4, respectively. Accordingly, although the hollow pipe 5 is inserted into the cabinet 4, the airtightness of the inside of the cabinet 4 is maintained. A sharp-pointed convex portion 7*a* is provided at the top of the support rod 7 inserted into the hollow pipe 5 and, at the same time, a bearing portion 8 having a conical concave portion 8*a* is fixed to the top board 4*c* of the cabinet 4. The concave portion 8*a* of the bearing portion 8 is supported at one point by the convex portion 7*a* of the support rod 7, which is in contact with the convex portion 8*a*, and undulates so as to move like a see-saw. Moreover, it is desirable that the top of the convex portion 7*a* be rounded.

Furthermore, this support rod 7 is extended outside the hollow pipe 5 by the through-hole 6 formed in the base board 4*b* of the cabinet 4, and a stand 9 is provided at the lower end of the support rod 7. Moreover, a buffer material 10 preferably including a soft material for preventing the occurrence of too much shaking of the cabinet 4 due to external vibration as well as impact and collision between the cabinet 4 and the support rod 7 is placed between the inner surface of the through hole 6 formed in the base board 4*b* of the cabinet 4 and the outer surface of the support rod 7. Moreover, an elastic body such as rubber, or other suitable material, is preferably used as a buffer material 10, but the buffer material 10 is not limited to this and a mechanical buffer (not illustrated) may also be used.

The speaker device 1 having the speaker cabinet 2 in which the frame of the speaker driver 3 is fixed to the side board 4*a* of the cabinet 4 is set on the floor surface F via the stand 9 provided at the lower end portion of the support rod 7. Then, after the vibration generated in the speaker device 1 has been conveyed from the side board 4*a* of the cabinet 4 constituting the speaker cabinet 2 to the base board 4*b* and the top board 4*c* and has been conveyed from the top board 4*c* to the support rod 7 through the bearing portion 8, the vibration is conveyed from the support rod 7 to the stand 9 and is diffused to the floor surface F.

Therefore, in the speaker device 1 according to the present preferred embodiment, when the sound volume generated at the speaker device 3 increases and the generated undesirable vibration increases, the whole cabinet 4 supported by the support rod 7 undulates so as to move like a see-saw at the center in the vicinity of the contact point between the concave portion 8*a* of the bearing portion 8 fixed to the top board 4*c* and the convex portion 7*a* of the support rod 7, that is, in the vicinity of the upper end in the height direction in the speaker cabinet 2.

That is, in this speaker device 1, the speaker cabinet 2 only undulates at the center in the vicinity of the top board 4*c* of the cabinet 4 where the bearing portion 8 is fixed and, when compared with the speaker device 51 as a related example, although the undulation increases in the vicinity of the base board 4*b* of the cabinet 4, the amplitude greatly decreases in the vicinity of the top board 4*c* and, as a result, the undulation is suppressed. Moreover, in the speaker cabinet 2, since the buffer material 10 is placed between the base board 4*b* of the cabinet 4 and the support rod 7, the undulation in the vicinity of the base board 4*b* of the cabinet 4 also does not increase so much.

Accordingly, when an audio system is built by using the speaker device 1 shown in FIG. 1, even if an auxiliary speaker 11 for reproducing a high frequency range and having a small amplitude such as a tweeter, etc., is placed on and fixed to the speaker cabinet 2 of the speaker device 1, the auxiliary speaker 11 does not undulate as much as in the related speaker device. As a result, the position of the sound source of the auxiliary speaker 11 is stabilized and the main objective of adding the auxiliary speaker 11 can be reliably obtained.

Furthermore, in the speaker device 1 according to the present preferred embodiment, although the hollow pipe 5 is inserted into the cabinet 4, the airtightness is maintained inside the cabinet 4. Therefore, when sound is reproduced, even if the atmospheric pressure is changed or the air is vibrated inside the cabinet 4, the airtightness is stabilized and there is an advantage in that dull sound due to insufficient airtightness is not generated.

The structure of the speaker device 1 is not limited to what is described with reference to FIG. 1, and the speaker device 1 may have the structure of a modified example shown in FIG. 2. That is, in the speaker cabinet 2 included in the speaker device 1 according to the present preferred embodiment, although the buffer material 10 is preferably placed between the inner surface of the through-hole 6 formed in the cabinet 4 and the outer surface of the support rod 7, even if the buffer material 10 is not placed therebetween, the same effect can be obtained as described above.

Furthermore, in the speaker device 1 shown in FIG. 2, although the hollow pipe 5 is preferably provided in the cabinet 4, the structure is not limited to that, and, as shown by imaginary lines in FIG. 2, the lower end portion of the hollow pipe 5 may be constructed so as to protrude to the outside through the base board 4*b* of the cabinet 4. When constructed in this way, the airtightness of the cabinet 4 is also maintained by the hollow pipe 5. Moreover, in the present preferred embodiment and the modified example, a method of piston movement in which sound is generated by the speaker driver 3 vibrating back and forth is assumed, but the way of generating sound is not limited to that and a method based on a breathing movement, a method using a flat piezoelectric plate, and others may be used.

On the other hand, in the present preferred embodiment, although the convex portion 7*a* disposed at the upper end portion of the support rod 7 is in contact with the concave portion 8*a* of the bearing portion 8, the concave portion 8*a* of the bearing portion 8 may be fixed so as to undulate. Furthermore, in the present preferred embodiment, although the cabinet 4 and the hollow pipe 5 are closed tightly, as shown in FIG. 2, a hole may be formed in a part of the hollow pipe 5 and the hollow pipe 5 can be used as a bass reflective port.

When a speaker cabinet included in a speaker device according to a preferred embodiment of the present invention is used, even if undesirable vibration transmitted from the speaker driver increases, since the speaker cabinet only undulates so as to move like a see-saw at the center in the vicinity of the top board of the cabinet supported by the support rod, the amplitude in the vicinity of the top board of the cabinet decreases and the undulation is suppressed. Then, when an audio system is built using the speaker device, even if an auxiliary speaker having a small amplitude is placed on and fixed to the speaker cabinet, the auxiliary speaker does not undulate so much.

Therefore, the position of the sound source of the auxiliary speaker is stabilized and the main objective of adding the auxiliary speaker 11 can be obtained. Furthermore, in the speaker cabinet according to preferred embodiments of the present invention, since the airtightness in the cabinet is maintained because of the hollow pipe, there is an advantage in that dull sound due to insufficient airtightness is not generated.

Furthermore, in the speaker device 1 shown in FIG. 2, although the top board 4*c* is preferably provided as an outside part of the speaker cabinet 2, the structure is not limited to that. The top board 4*c* which has the bearing portion 8 may be constructed so as to be located and provided in the speaker cabinet 2. In addition, an outside top board which defines an outside part of the speaker cabinet 2 may also be provided. In this structure, the same effects as those described above can be also obtained.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A speaker cabinet comprising:

a cabinet having a side board to which a speaker driver is directly fixed and having a base board and a top board;

a substantially cylindrical tube which is inserted into the cabinet such that a vertical line passing through a center of gravity of a horizontal plane of the cabinet coincides with an axis of the substantially cylindrical tube and which is in contact with the base board and the top board of the cabinet; and a support rod which is inserted into the substantially cylindrical tube through a through-hole formed in the base board of the cabinet and which supports the top board of the cabinet at an upper end portion of the support rod such that the cabinet undulates so as to move like a see-saw; wherein the substantially cylindrical tube is fixed to the cabinet.

2. A speaker cabinet as claimed in claim 1, wherein the upper end portion of the support rod has a sharp point and a bearing portion, which is in contact with the upper end portion of the support rod, is provided in the top board of the cabinet.

3. A speaker cabinet as claimed in claim 1, wherein a buffer material is disposed between an inner surface of the through hole formed in the base board of the cabinet and an outer surface of the support rod.

4. A speaker cabinet as claimed in claim 1, wherein the speaker cabinet is a box-type hollow cabinet.

5. A speaker cabinet as claimed in claim 2, wherein the bearing portion has a conical concave portion fixed to the top board of the cabinet.

6. A speaker cabinet as claimed in claim 1, wherein the support rod extends outside the hollow pipe through the through-hole formed in the base board of the cabinet.

7. A speaker cabinet as claimed in claim 1, further comprising a stand provided at a lower end of the support rod.

8. A speaker cabinet as claimed in claim 1, further comprising an outside top board defining an outside part of the cabinet, wherein the top board is provided in the cabinet.

9. A speaker device comprising:

a cabinet having a side board, a base board and a top board;

a substantially cylindrical tube which is inserted into the cabinet such that a vertical line passing through a center of gravity of a horizontal plane of the cabinet coincides with an axis of the substantially cylindrical tube and which is fixed to the cabinet;

a support rod which is inserted into the substantially cylindrical tube through a through-hole formed in the base board of the cabinet and which supports the top board of the cabinet at an upper end portion of the support rod such that the cabinet undulates so as to move like a see-saw; and a speaker driver fixed directly to the side board of the cabinet; wherein the substantially cylindrical tube is in direct contact with an inner surface of the top board of the cabinet.

10. A speaker device as claimed in claim 9, wherein the upper end portion of the support rod has a sharp point and a bearing portion, which is in contact with the upper end portion of the support rod, is provided in the top board of the cabinet.

11. A speaker device as claimed in claim 9, wherein a buffer material is disposed between an inner surface of the through hole formed in the base board of the cabinet and an outer surface of the support rod.

12. A speaker device as claimed in claim 9, wherein the speaker cabinet is a box-type hollow cabinet.

13. A speaker device as claimed in claim 10, wherein the bearing portion has a conical concave portion fixed to the top board of the cabinet.

14. A speaker device as claimed in claim 9, wherein the support rod extends outside the hollow pipe through the through-hole formed in the base board of the cabinet.

15. A speaker device as claimed in claim 9, further comprising a stand provided at a lower end of the support rod.

16. A speaker device as claimed in claim 9, further comprising an outside top board defining an outside part of the cabinet, wherein the top board is provided in the cabinet.

* * * * *